US008220672B2

(12) United States Patent
Zirps

(10) Patent No.: US 8,220,672 B2
(45) Date of Patent: Jul. 17, 2012

(54) FLUID DISPENSING APPARATUSES AND METHODS THEREOF

(75) Inventor: Christopher T. Zirps, Sharon, MA (US)

(73) Assignee: MooBella, Inc., Taunton, MA (US)

( * ) Notice: Subject to any disclaimer, the term of this patent is extended or adjusted under 35 U.S.C. 154(b) by 985 days.

(21) Appl. No.: 12/229,523

(22) Filed: Aug. 22, 2008

(65) Prior Publication Data

US 2009/0127297 A1 May 21, 2009

Related U.S. Application Data

(60) Provisional application No. 60/966,081, filed on Aug. 23, 2007.

(51) Int. Cl.
*B67D 7/72* (2010.01)

(52) U.S. Cl. ..... 222/630; 222/61; 222/129; 222/129.3; 222/145.2; 222/52; 141/116

(58) Field of Classification Search ..... 430/270.1, 430/326, 910; 222/52, 61, 129, 129.1, 129.3, 222/129.4, 132, 135, 138, 145.1, 145.2, 145.5, 222/145.7, 152, 148, 190, 630, 637, 144.5, 222/394; 141/115–117, 119
See application file for complete search history.

(56) References Cited

U.S. PATENT DOCUMENTS

| | | | | |
|---|---|---|---|---|
| 3,511,468 | A * | 5/1970 | Young | 251/6 |
| 4,042,151 | A | 8/1977 | Uttech | 222/129.2 |
| 5,072,853 | A * | 12/1991 | Shannon | 222/1 |
| 6,019,254 | A * | 2/2000 | Kameyama et al. | 222/129.1 |
| 6,371,331 | B1 * | 4/2002 | Gohde et al. | 222/55 |
| 6,446,834 | B2 * | 9/2002 | Davis et al. | 222/52 |
| 6,737,022 | B1 * | 5/2004 | Sutton et al. | 422/70 |
| 7,914,199 | B2 * | 3/2011 | Kateman et al. | 366/144 |

FOREIGN PATENT DOCUMENTS

WO WO 99/25466 5/1999

* cited by examiner

*Primary Examiner* — J. Casimer Jacyna
(74) *Attorney, Agent, or Firm* — McCarter & English LLP

(57) ABSTRACT

A system for dispensing with a valve-less block including internal air passages coupled with an air source and internal dispensing passages coupled with a flow channel. The flow channel is disposed external to the block and couples with a fluid source. The dispensing passages are further configured in fluid communication with the air passages and place the flow channels in fluid communication with the air passages. A port is defined in the block to dispense fluid from the block. At least one sensor is coupled with each flow channel and indicates the presence of at least one of air and fluid in the flow channel. The detection of air or fluid ensures a location of a flow front of a fluid residing in the flow channel, and ensures the presence of an air gap that serves as a check valve to prevent mixing of fluids and to prevent backflow.

16 Claims, 4 Drawing Sheets

FLUID DISPENSING APPARATUSES AND METHODS THEREOF

RELATED APPLICATIONS

This application claims priority to U.S. provisional application Ser. No. 60/966,081, filed Aug. 23, 2007, the content of which is hereby incorporated by reference in its entirety.

TECHNICAL FIELD

The invention provides apparatuses and methods of dispensing one or more fluids, such as liquids, from single or multiple sources and delivering fluids for further processing.

BACKGROUND

Automated systems and methods of producing food products on-demand in accordance with customer specification are disclosed in U.S. Pat. No. 7,052,728, U.S. Publication No. 2006/0162347 A1, U.S. Publication No. 2007/0251260 A1, and U.S. Publication No. 2006/0054614 A1, all of which are commonly owned by the Assignee of the present application. Such systems and methods produce and dispense, e.g., for immediate consumption, aerated and/or blended food products, such as ice cream and frozen yogurt, that are produced from customer-selected product base mixes, flavorings, and other ingredients. Various subsystems and components of such systems and methods deliver a selected product base mix and one or more flavorings from storage containers to one or more modules within which mixing, blending and/or aerating of base mix and flavorings are performed to produce the customer-specified food product. Many of such subsystems and components include mechanical components that contact product base mixes, flavorings, and formed food products during production that require purging and cleaning between production cycles to prevent introduction of any residual food product, base mix or flavorings, referred to as carry over, into subsequent production cycles and food products. Carry over is undesirable in that, for instance, a flavoring from a previously produced food product is incorporated or deposited with a subsequently produced food product. Thus, any systems and methods directed to help to reduce or eliminate carry-over between production cycles is desirable.

SUMMARY

The present invention is directed to improved and alternative systems and methods of delivering for processing one or more food product flavorings from a variety of flavorings in accordance with customer specification. More particularly, the present invention is directed to an alternative to the flavor-selection assembly 208, and may be integrated with the flavor module 14, of the apparatus and methods described in U.S. Patent Application Publication No. 2006/0054614 A1, entitled "Systems and Methods for Dispensing Product," filed May 27, 2005 and assigned application Ser. No. 11/140,624, which is fully incorporated into this disclosure by reference. The flavor-selection assembly 208 operates to multiplex flavors with a customer-selected product base mix and dispenses one or more customer-selected flavorings with certain metering and timing and without introduction of other flavorings into a production cycle, which forms a final food product.

The present invention provides valve-less apparatuses and methods for dispensing of selected flavorings into production cycles of food products that help to eliminate or at least minimize the introduction of previously selected flavorings or carry over from prior production cycles and formed food products. The present invention also helps to eliminate or at least minimize performance and maintenance problems associated with valved mechanical dispensing systems.

In general, in an aspect the invention provides a system for dispensing fluid for a food product includes a valve-less fluid block including one or more internal air passages defined within its interior with each air passage configured to operatively couple with an air source. The block includes one or more internal dispensing passages defined within the block interior. Each dispensing passage is configured to operatively couple with a flow channel. The flow channel is disposed external to the block and is configured to operatively couple with a fluid source. The dispensing passages are disposed and further configured in fluid communication with the air passages within the interior of the block and place the flow channels in fluid communication with the air passages. The block defines a port that is adapted to dispense fluid from the interior of the block. At least one sensor is operatively coupled with each flow channel. The sensor is configured to detect and to indicate the presence of at least one of air and fluid in the flow channel. The detection of air and/or fluid helps to ensure a location of a flow front of a fluid residing in the flow channel, and helps to ensure the presence of an air gap in the flow channel that serves as a check valve to prevent mixing of the fluid with other idle and unselected fluids the block is disposed to dispense and to prevent backflow of a dispensed fluid. At least one air passage is configured to deliver air to the block such that air entrains and carries a fluid dispensing from the dispensing passage to the port for dispensing from the block. Each flow channel may operatively couple with a pump disposed and configured to draw a fluid from the fluid source.

In general, in another aspect the invention provides the system for dispensing fluid for a food product including the valve-less fluid block described above with the block operatively connected to a plurality of flow channels, pumps, and fluid sources to dispense a multiple of different fluids.

In general, in a further aspect the invention provides the system of dispensing fluid for a food product including a plurality of the valve-less fluid block described above and a plurality of flow channels, pumps, and fluid sources to provide multiple dispensing systems.

Various aspects of the invention may provide one or more of the following capabilities and advantages. A selected flavoring dispenses into an apparatus for producing a food product without introduction of unwanted flavorings and/or other ingredients. Residual flavoring and carry over may be reduced or minimized in the food production apparatus with a valve-less flavoring dispensing apparatus and method. A selected flavoring may dispense into the apparatus with correct metering and timing. Elimination of valves may reduce the frequency of maintenance and cleaning of a flavoring selection and dispensing apparatus. Air gaps created within flow channels delivering flavoring to the apparatus serve as check valves that may help to prevent mixing of unselected and idle flavorings and help to prevent backflow of a selected and dispensed flavoring. These and other capabilities and advantages of the invention, along with the invention itself, will be more fully understood after a review of the following figures, detailed description, and claims.

BRIEF DESCRIPTION OF THE DRAWINGS

Figures provided herein are for illustrative purposes and do not limit the scope and spirit of the invention, and employ the same reference numerals for the same or similar elements.

DETAIL DESCRIPTION

Figure 1:
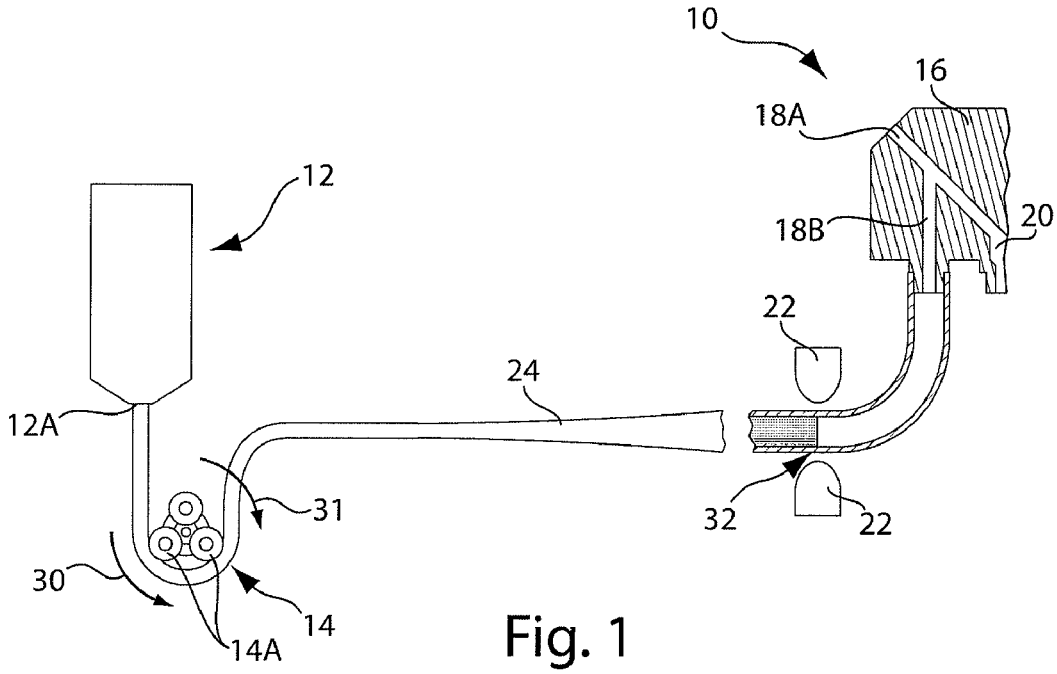
FIG. 1 is a schematic illustration of one aspect of the invention providing a valve-less dispensing apparatus.
Figure 2:
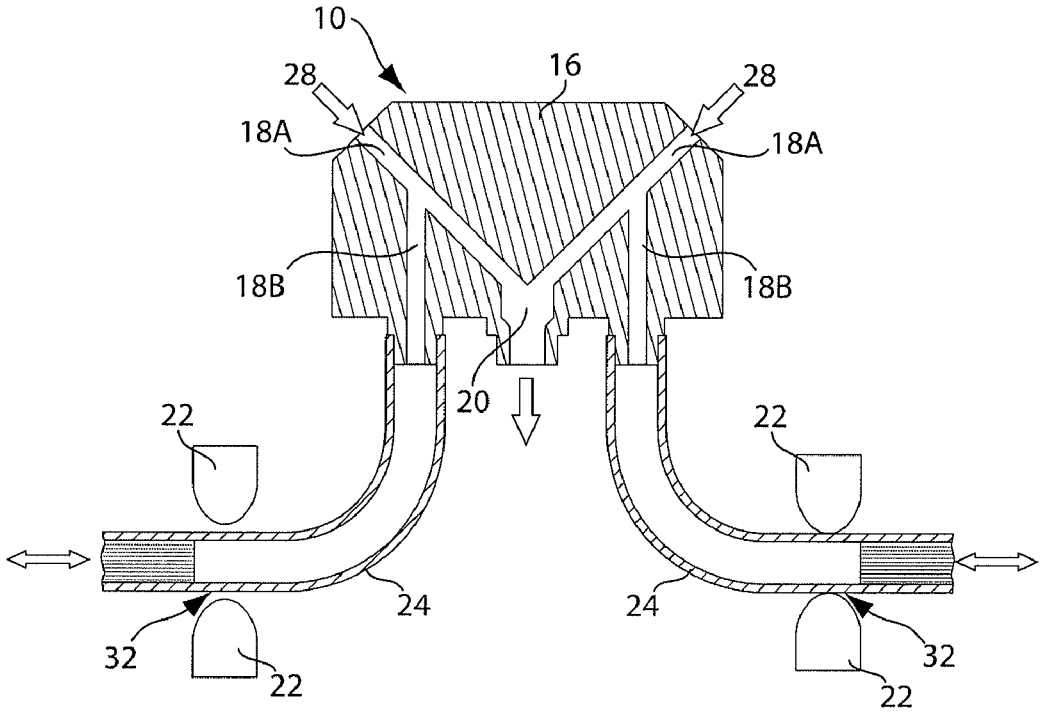
FIG. 2 is a schematic illustration of the apparatus shown in FIG. 1 during initial phases of dispensing.

Referring to FIGS. 1 and 2, in an aspect the invention provides a valve-less flavor selection and dispensing apparatus 10 including a flavor block 16 having a plurality of internal air passages 18A in fluid communication with a central internal passage 20. The apparatus 10 also includes a plurality of internal dispensing passages 18B operatively coupled with a plurality of external flow channels 24 such that each flow channel 24 is in fluid communication with at least one dispensing passage 18B. Some or all of the dispensing passages 18B couple with some or all of the air passages 18A to place the passages 18B in fluid communication with the passages 18A. The dispensing passages 18B may also serve as air passages during certain phases of dispensing and purging, as described below.

The plurality of flow channels 24 are constructed and arranged to operatively connect to a plurality of flavor reservoirs or containers 12, e.g., disposed remotely from the flavor block 16. The flavor containers 12 are configured to operatively couple with the plurality of flow channels 24 such that each container 12 is in fluid communication with one of the flow channels 24. Each container 12 and flow channel 24 is thereby in fluid communication with a designated passage 18B and the central passage 20 of the flavor block 16. Each container 12 is constructed and arranged to house and dispense a flavoring. After dispensing of a flavoring from the block 16, processes may incorporate the selected flavoring with a product base mix and one or more other ingredients of a food product.

Each flow channel 24 includes at least one sensor, e.g., ultrasonic sensor, configured for detection of the presence of air and/or a flavor substance in the flow channel 24. In addition, each flow channel operatively couples with at least one pump 14, e.g., positive-displacement, volumetric and/or peristaltic pumps, configured for manipulation and delivery of a flavor substance from a corresponding food container 12 and pushing the flavor substance through a corresponding flow channel 24.

Although FIGS. 1 and 2 illustrate a single flavor block 16, flavor container 12, flow channel 24, pump 14 and sensor 22, the invention may include a plurality of flavor blocks 16 and a plurality of flavor containers 12, flow channels 24 and pumps 14 to deliver multiple flavor substances or flavorings. The plurality of flow channels 24, pumps 14, and containers 12 may include or may be arranged similar to the flavor module 14 described in U.S. Patent Application No. 2006/0054614 A1. In addition, the apparatus 10 may be used to deliver other fluid substances, e.g., air, water, and liquid, liquid-based, or liquid-dispersed food product base mixes, food ingredients, and food, nutritional, and energy supplements. Alternatively, or additionally, other ingredient containers may replace the flavor containers 12. Further, flavorings the containers 12 house and dispense may be supplied in a powder, liquid, liquid-based, or other form in the apparatus 10 described herein. The invention disclosed in the detailed description that follows refers to flavorings used for food products although one of ordinary skill will understood that any substances might substitute the flavorings in alternative embodiments.

The flavor block 16 shown in FIGS. 1 and 2 is constructed and arranged with a radial design, wherein the plurality of air passages 18A is arranged within the block 16 such that the passages 18A radiate from or converge to the central passage 20. Similarly, the flavor block 16 may be constructed and arranged with the plurality of dispensing passages 18B, which may also serve as air passages as described below, arranged in the block 16 such that the passages 18B radiate from or converge to the central passage 20. As shown in FIGS. 1 and 2, the air passages 18A may be located along an upper portion of the block 16 and the dispensing passages 18B may be located along a lower portion of the block 16. The invention however is not limited in this respect and envisions any arrangement of the passages 18A and 18B in the block 16.

The flavor block 16 is constructed as a machined or an injection molded block and is constructed of one or more materials suitable for use in food production equipment including, but not limited to, plastic, stainless steal, and ceramic. In addition, internal surfaces of some or all of the passages 18A, 18B and 20 are coated with one or more materials, and/or are otherwise treated, to provide non-stick internal surfaces. Such non-stick surfaces help to ensure, when required, rapid and consistent pressurization of the block 16, e.g., with the introduction of pressurized air. Non-stick surfaces also help to ensure clear pathways for air and flavorings. Materials of construction and non-stick materials may be NSF approved.

Each of the plurality of air passages 18A is configured and is disposed to deliver a supply of air 26 and 28, e.g., pressurized or non-pressurized air, from one or more external air sources to the block 16 and the central passage 20 for a variety of purposes prior to, during and after dispensing cycles. Each of the plurality of dispensing passages 18B is configured and is disposed to deliver a supply of flavoring to the block 16 and central passage 20 and to receive, when required or desired, flow of air 28 prior to, during and after dispensing cycles.

Figure 4:
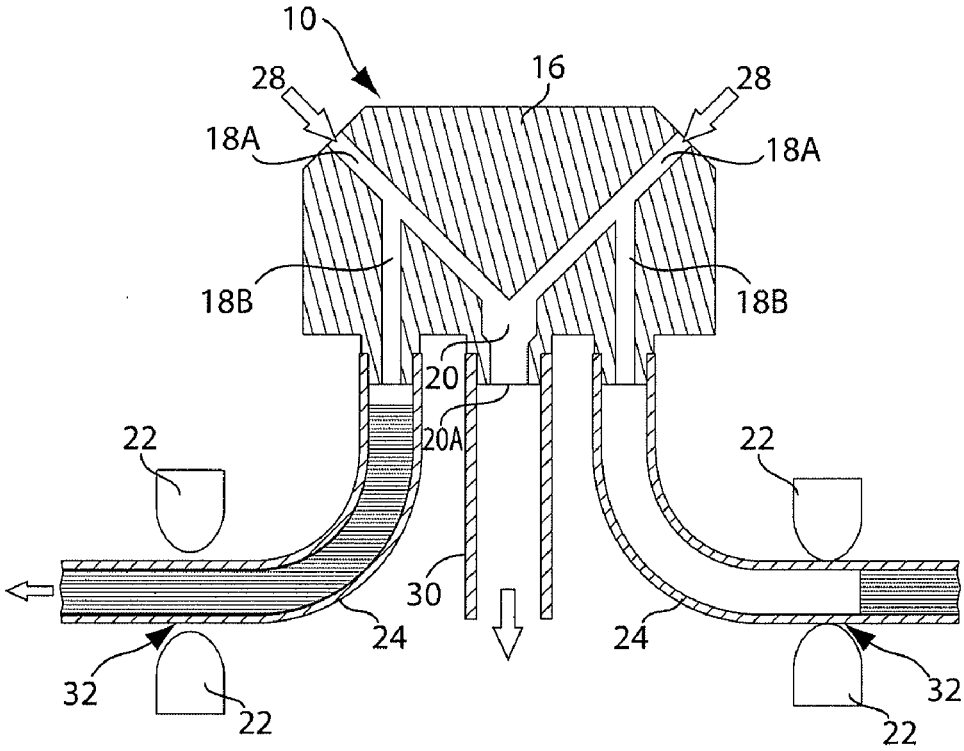
FIG. 4 is a schematic illustration of the apparatus show in FIG. 1 during phases of purging.

Referring to FIG. 4, and with further reference to FIGS. 1 and 2, the flavor container 12 is disposed remotely from the flavor block 16, e.g., although may be located in close vicinity to or within the same enclosure as the flavor block 16. The pump 14 dedicated to the flavor container 12 operationally isolates the container 12 from the apparatus 10 and, when actuated, enables flow of flavoring from the container 12 and fluid communication of the container 12 with the flow channel 24, the corresponding dispensing passage 18B, and the block 16. For purposes of disclosure of the invention, the pump(s) 14 is/are described as peristaltic pump(s); however, the invention is not limited in this respect and envisions other types of pumps including, but not limited to, positive displacement and volumetric pumps may be employed as an alternative to, or in addition to, peristaltic pumps.

Figure 3:
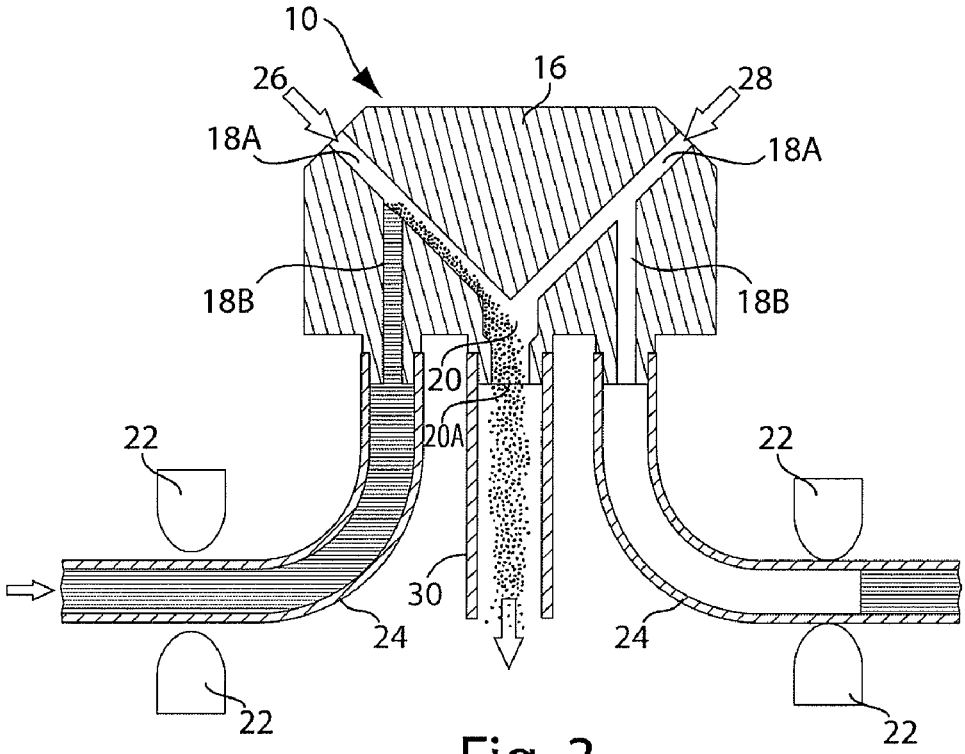
FIG. 3 is a schematic illustration of the apparatus shown in FIG. 1 during dispensing of a single fluid.

In one embodiment, the pump 14 includes a peristaltic pump 14 including a plurality of shoes or rollers 14A about its perimeter such that, when the pump 14 rotates, the rollers 14A draw a flavoring from the container 12 through a port 12A and drive or push the flavoring through the corresponding flow channel 24. The rollers 14A may rotate in a counterclockwise direction, as shown by arrow 30 in FIG. 1, to create positive displacement along the flow channel 24 to push the flavoring into and through the flow channel 24, while generating a vacuum upstream of the pump 14, which helps to draw out more flavoring from the container 14 and through the port 14A. In one embodiment, at least a portion of the flow channel 24 may be constructed of one or more materials suitable to enable the pump 14 to compress a portion of the flow channel 24 with which the rollers 14A are in contact at any given moment to thereby push the flavoring via positive displacement into and along the flow channel 24, while generating a vacuum upstream of the pump 14 as described. As shown in FIG. 3, action of the pump 14 helps to push the flavoring into the corresponding dispensing passage 18B of the flavor block 16. In addition, action of the pump 14 helps to manipulate the flavoring residing within the flow channel 24, e.g., during retraction, as described below, and when the flavoring is not being dispensed, to help to prevent formation of and to help to eliminate air and bubbles in the flavoring stream.

The peristaltic pump 14 achieves a required or desired flow rate in accordance with, for instance, operating parameters of the flavor block 16 and viscosities of selected flavorings. An advantage of using the peristaltic pump 14 is that the pump 14 does not contaminate the flavoring flowing through the flow channel 24. In turn, the flavoring does not contaminate the pump 14.

The flow channel 24 may include within its interior one or more notches, protrusions, or other configurations to help to provide flow resistance to the flavoring being pushing through the flow channel 24, which thereby helps to dampen inherent pulsating of the flavoring due to operation of the peristaltic pump 14.

As shown in FIG. 4, and with further reference to FIGS. 1-3, subsequent to delivery of a supply of the selected flavoring to the flavor block 16, a flow front of the flavoring retracts within the flow channel 24 away from the block 16 to a configurable and/or predetermined point 32 along the flow channel 24. Retraction of the flow front helps to prevent further dispensing of the flavoring into the block 16. In addition, retraction of the flow front helps to ensure a gap, e.g., air gap, creates within the flow passage 24 sufficient to isolate the flavoring from the corresponding dispensing passage 18B, air passage 18A and central passage 20. The air gap may exist between and during dispensing cycles to help to isolate each flavoring from other flavorings, to prevent intermixing of flavorings, and/or to help to prevent or at least minimize flavoring carry over from one production cycle to another.

Retraction is accomplished in any of a number of ways. In one embodiment, the pump 14 accomplishes retraction by operating in reverse with the rollers 14A rotating in a clockwise direction, as shown by arrow 31 in FIG. 1. The pump 14 draws the flavoring to flow in a reverse direction until the flow front retracts to a configurable and/or predetermined point 32 such that a sufficient air gap creates in the flow channel 24. The sensor 22, operatively coupled with the flow channel 24, is configured to detect the presence of air and/or of flavoring in the flow channel 24. The sensor 22 thereby helps to indicate the location of the flow front within the channel 24 such that the pump 14 may operate in reverse to retract the flow front until the sensor 22 detects and indicates that air is present in the flow channel 24. Similarly, the sensor 22 detects the presence of the flavoring in the flow channel 24 and may assist in dispensing flavoring whereby the pump 14 operates to draw and to push the flavoring through the flow channel 24 until the sensor detects the presence of flavoring, e.g., for a given period of time, in the flow channel 24 to help to determine if a sufficient amount or volume of flavoring has been or will be dispensed.

Each dispensing passage 18B is configured and disposed to operatively couple with the corresponding flow channel 24, to receive the dispensed flavoring and to deliver the flavoring into the interior of the block 16 and the central internal passage 20.

In addition, each passage 18B is configured and disposed in fluid communication with one or more passages 18A to receive air 28, e.g., pressurize or non-pressurized air, from one or more passages air 18A. Each passage 18B receives periodic bursts or purges of air 28 delivered to the block 16 to help to prevent back flow of any flavoring a pump 14 is dispensing into one or more unused passages 18B. Purge air 28 also helps to prevent back flow of dispensed flavoring from the central passage 20. In addition, purge air 28 helps to clear any residual flavoring remaining within the dispensing passage 18B and the central passage 20 after the flavoring dispenses from the block 16. Each passage 18B permits purge air 28 to flow therethrough and into the flavoring residing in the corresponding flow channel 24 to help to prevent solidification of the flavoring and to help to remove any bubbles and slugs from the flavoring. Further, purge air 28 helps to retract the flavoring subsequent to its dispensation, as well as helps to retract, or maintain in retracted locations, unselected and idled flavorings residing in the flow channels 24.

An air passage 18A corresponding to the dispensing passage 18B delivers a stream of air 26, e.g., pressurized or non-pressurized air, to the block 16 that mixes with the dispensing flavoring. As shown in FIG. 3, the air stream 26 entrains and mixes with the flavoring to help to accelerate the flavoring to the center passage 20. Purge air 28 delivered from one or more other air passages 18A may also mix with the flavoring to help to achieve a certain level of aeration of the flavoring, if required or desired. As mentioned, purge air 28 helps to prevent the dispensed flavoring from flowing into any unused passages 18A and 18B. In particular, purge air 28 enters the other unused passages 18A and 18B and, optionally, portions of the other flow channels 24, to help to prevent flow of unselected flavorings into the block 16. Purge air 28 thereby serves as a check-valve to the passages 18A and/or 18B.

The central passage 20 is configured to allow the air and flavoring mixture to flow therethrough, e.g., in a downward orientation, and through an outlet port 20A into a tube 30, e.g., a mixing tube operatively connected with the outlet port 20A. The mixing tube 30 may deliver the air and flavoring mixture to a turbulence tube 68, such as described in copending U.S. application Ser. No. 12/154,080, filed May 19, 2008, or other mixing or dispensing apparatus that blends, mixes, or otherwise combines the air and flavoring mixture with a product base mix.

Referring to FIG. 4, air passages 18A continue to deliver purge air 28 into the block 16 and through the central passage 20, its port 20A and other unused passages 18B after the air and flavoring mixture dispenses from the central passage 20. Purge air 28 helps to carry away any residual flavoring remaining along the passage 18B from which the flavoring dispensed, as well as along the air passage 18A corresponding to the flavoring passage 18B, and the interior walls and other portions of the central passage 20 and port 20A.

Figure 5:
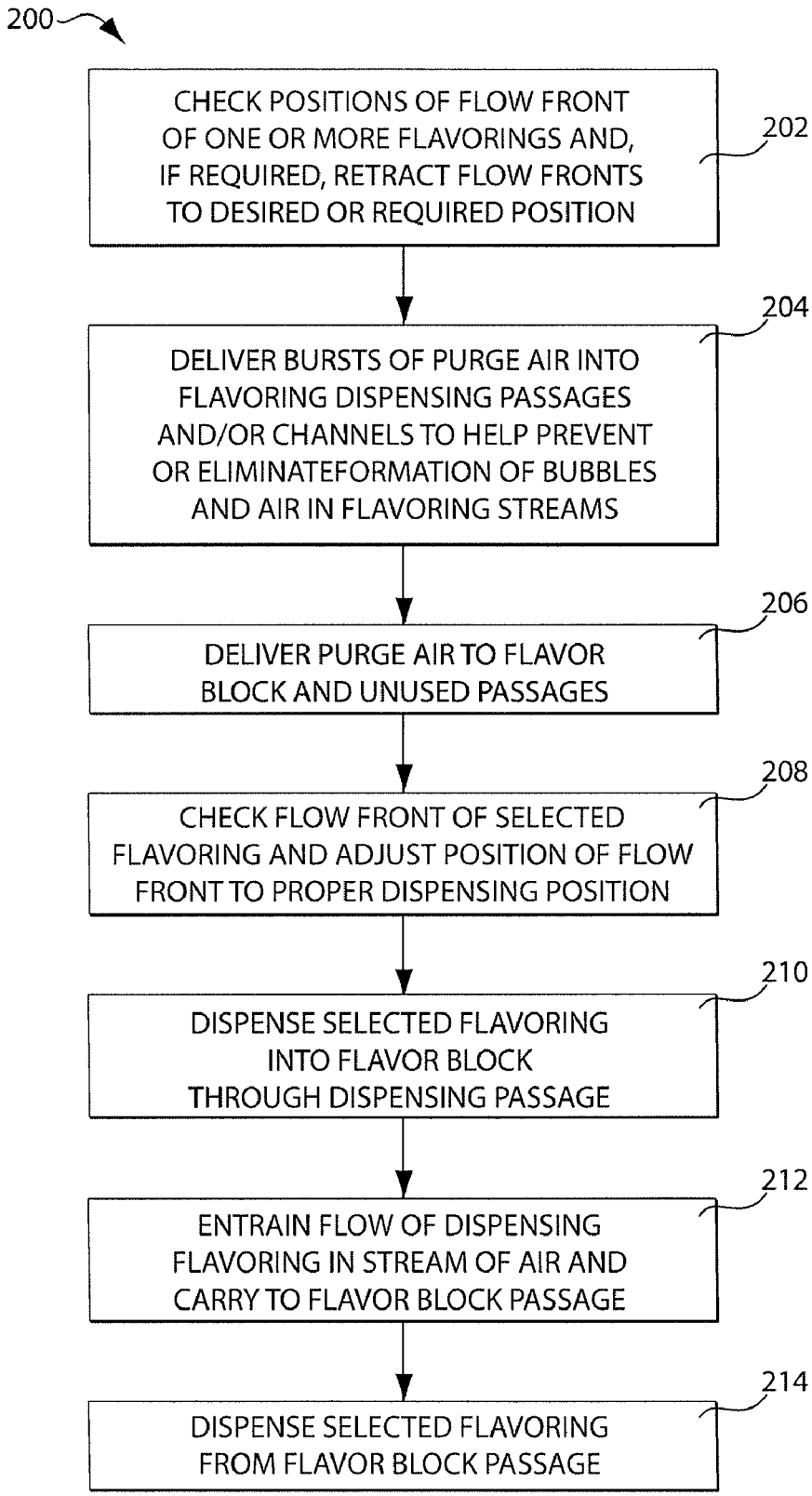
FIG. 5 is a flow diagram of another aspect of the invention providing a process or method of dispensing a fluid.

In operation, referring to FIG. 5, and with further reference to FIGS. 1-4, a flow diagram illustrates another aspect of the invention providing a process or method 200 for dispensing a selected fluid, such as a liquid flavoring, using the apparatus 10 described above. The method 200, however, is exemplary only and not limiting. The method may be altered, e.g., by having stages added, removed or rearranged.

At stage 202, prior to and between dispensing cycles, each pump 14 retracts, if required, the flow front of the respective flavoring residing within the corresponding flow channel 24.

The pump 14 operates, e.g., in reverse in a clockwise direction as shown by arrow 31 in FIG. 1, to retract the flow front. The pump 14 continues to operate until the at least one sensor 22 detects and indicates the presence of air within the flow channel 24. Each sensor 22 operatively couples to the corresponding flow channel 24 along or proximate to the configurable and/or predetermined point 32 such that the sensor 22 indicates the position of the flow front, e.g., when it is behind or upstream from the point 32. In addition, each sensor 22 helps to monitor the presence of air gaps established in the dispensing passages 18B and the flow channels 24, e.g., in front of or downstream from the point 32. Retraction of the flow front, e.g., behind or upstream from the point 32 helps to create an air gap sufficient to isolate the flavoring from the corresponding dispensing passage 18B, air passage 18A and central passage 20.

At stage 204, optionally, the pump 14 may manipulate the flavoring residing within the corresponding flow channel 24 to help to prevent or eliminate formation of bubbles and air along the flavoring stream. One or more air passages 18A may deliver bursts of purge air 28 into the block 16 and the corresponding dispensing passage 18B and flow channel 24 to help to prevent solidification of the flavoring residing in the flow channel 24.

At stage 206, the air passages 18A deliver purge air 28 to the flavor block 16 and unused dispensing passages 18B.

At stage 208, the sensors 22 check and indicate positions of the flow fronts. If required, the pump 14 of the selected flavoring operates, e.g., the rollers 14A operate in a counterclockwise direction as shown by arrow 30 in FIG. 1, to move the flow front of the selected flavoring to the point 32 until the corresponding sensor 22 detects and indicates the presence of the flow front.

At stage 210, the pump 14 continues or begins to operate to draw the selected flavoring from the corresponding container 12 through its port 12A and to push the selected flavoring through the flow channel 24 and the corresponding dispensing channel 18B.

At stage 212, the corresponding air passage 18A delivering purge air provides a stream of air 26 that entrains and mixes with the selected flavoring dispensing from the dispensing passage 18B, and accelerates the selected flavoring to the central passage 20.

At stage 214, the flavoring mixes with air along the air passage 18A and the mixture of air and selected flavoring flows through the central passage 20 and its port 20A into the mixing tube 30.

At stage 216, purge air 28 continues to flow through one or more air passages 18A to help to remove residual flavoring from the dispensing passage 18B, the corresponding central passage 20, and the port 20A. Optionally, a lag period of a configurable and/or predetermined amount of time establishes before initiation of the next dispensing cycle to help to ensure removal of residual flavoring from the block 16, sufficient retraction of the flow front of the selected flavoring, and sufficient air gaps along the flow channels 24 and, optionally, the dispensing passages 18B relative to the interior of the block 16 and the air passages 18A.

At stage 218, the pump 14 reverses operation, e.g., the rollers 14A move in a clockwise direction as shown by arrow 31 in FIG. 1, to retract the flow front of the selected flavoring until the sensor 22 detects the presence of air within the flow channel 24 to indicate the position of the flow front of the selected flavoring, e.g., is behind or upstream from the point 32. The air passages 18A discontinue supplying purge air 28 to the flavor block.

Figure 6:
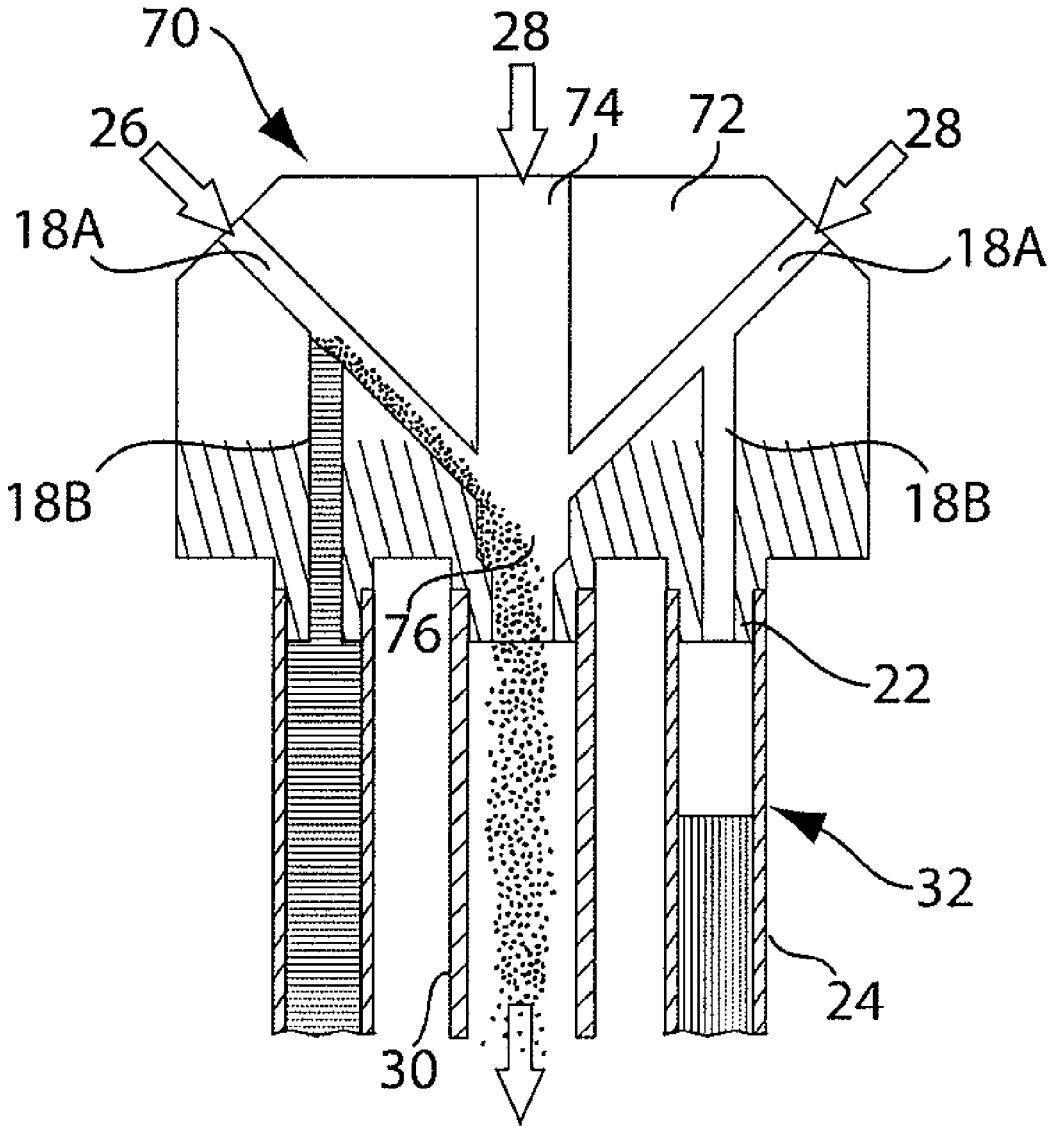
FIG. 6 is a schematic illustration of a further aspect of the invention providing a dispensing apparatus.

Referring to FIG. 6, in another aspect the invention provides a valve-less flavor dispensing apparatus 70 including a flavor block 72 that is a modification and alternative embodiment of the radial valve-less flavor block 16 shown and described with reference to FIGS. 1-5. The flavor block 72 operatively couples with the plurality of containers 12, pumps 14, sensors 22, and flow channels 24, as shown and described with reference to FIGS. 1-5. In addition, the system 70 operates substantially similar to the operation of the apparatus 10, as shown and described with reference to FIGS. 1-5. The flavor block 72 includes an air inlet 74 that may be disposed at an axis central to the flavor block 72. The air inlet 74 is constructed and arranged to deliver air, e.g., pressurized or non-pressurized air, to an internal passage 76. Similarly, the internal passage 76 may be defined along an axis central to the flavor block 72. The air inlet 74 may be equipped with a check valve to prevent backflow of a mixture of selected flavoring and air within the internal passage 76. The air inlet 74 is configured and disposed to supply purge air 28 to the passage 76 to help to clean residual flavoring within the passage 76 and the dispensing passages 18B. In addition, the air inlet 74 is configured and disposed to supply purge air 28 to help to retract the selected flavoring flow front after dispensing and to help to maintain the flavoring flow fronts, e.g., behind or upstream from the point 32, when such flavorings are idle or non-selected.

In addition, a portion of the air passages 18A and/or the intersection of the air passages 18A and the internal passage 76 may define an angle such that where the selected flavoring is entrained with a stream of air 26 and accelerated to the passage 20, the selected flavoring may project and contact an inner wall of the passage 20.

Further, the air inlet 74 may supply air, e.g., pressurized or non-pressurized air, to mix with the selected flavoring to help to aerate the selected flavoring when flowing through the passage 76, if required or desired. In addition, the air inlet 74 supplies large volumes of air, e.g., pressurized or non-pressurized air, into the passage 76, and may supply volumes of air, e.g., pressurized or non-pressurized air, into a mixing tube into which the passage 76 dispenses the mixture of selected flavoring and air.

Having thus described at least one aspect of the invention, various alterations, modifications and improvements will readily occur to those skilled in the art. Such alterations, modifications and improvements are intended to be within the scope and spirit of the invention. Accordingly, the foregoing description is by way of example only and is not intended as limiting.

What is claimed is:

1. A system for dispensing fluid for a food product, the system comprising: a valve-less fluid block including at least one internal air passage and at least one internal fluid dispensing passage defined within an interior of the fluid block;

the at least one air passage configured to receive air from an air source and to permit air to flow through the interior of the block to a central dispensing passage defined within the interior of the block;

the at least one fluid dispensing passage configured to receive and to permit flow of a volume of fluid through the interior of the block to the central dispensing passage;

the central dispensing passage disposed in fluid communication with the at least one air passage and with the at least one fluid dispensing passage such that, the central dispensing passage receives air and the volume of fluid and is configured to permit mixing of the volume of fluid with air, the central dispensing passage defining a port to dispense the mixture of fluid and air from the fluid block;

at least one flow channel disposed externally to the fluid block and connected operatively to the at least one fluid dispensing passage at one end and connected operatively to a fluid container at another opposite end such that, the at least one flow channel is in fluid communication with the fluid container and the at least one fluid dispensing passage, the flow channel configured to permit flow of the volume of fluid dispensed from the fluid container to the at least one fluid dispensing passage;

a pump connected operatively between the fluid container and the at least one flow channel and configured to draw the volume of fluid from the fluid container and to create sufficient pressure within the at least one flow channel to drive the volume of fluid through the at least one flow channel to the fluid block, the pump constructed and arranged to retract flow of the volume of fluid such that a flow front of the volume of fluid is retracted within the at least one flow channel in an opposite direction to dispensing to a specific point along the at least one flow channel, and at least one sensor coupled operatively with the flow channel, the sensor being configured to detect a presence of at least one of: air and fluid disposed in the flow channel, wherein the at least one sensor detects the presence of a flow front of the volume of fluid disposed in the at least one fluid dispensing passage.

2. The system of claim 1 wherein the pump includes a positive displacement pump configured when actuated to create positive displacement along the at least one flow channel to drive the volume of fluid through the at least one flow channel, while generating a vacuum upstream of the pump to draw the volume of fluid from the fluid container.

3. The system of claim 1 wherein the pump is constructed and arranged to achieve a required or desired flow rate of the volume of fluid.

4. The system of claim 1 wherein the at least one flow channel defines along at least a portion of its interior one or more notches, protrusions or other configurations.

5. The system of claim 1 wherein the sensor is configured to detect the presence of the volume of fluid and the presence of air within the interior of the at least one flow channel to detect whether a flow front of fluid within the flow channel is substantially proximate to or behind a specific point along the at least one flow channel.

6. The system of claim 5 wherein the sensor and the pump are coupled operatively such that the pump retracts the flow front of the volume of fluid substantially proximate to or behind the specific point along the at least one flow channel until the sensor detects the presence of air.

7. The system of claim 5 wherein the sensor and the pump are coupled operatively such that the pump drives flow of the volume of fluid through the at least one flow channel to the fluid block until the sensor detects the presence of fluid for a given period of time.

8. The system of claim 1 wherein the at least one air passage includes a plurality of air passages radiating from the central dispensing passage along one interior portion of the fluid block, and wherein the at least one fluid dispensing passage includes a plurality of dispensing passages radiating from the central dispensing passage along another interior portion of the fluid block.

9. The system of claim 1 wherein the at least one air passage is configured and disposed within the interior of the fluid block in relation to the at least one fluid dispensing passage such that air that the air passage delivers into the fluid block mixes with the volume of fluid that the dispensing passage delivers into the fluid block.

10. The system of claim 1 wherein the at least one air passage is configured and disposed in relation to the at least one fluid dispensing passage such that the at least one air passage delivers purge air into the central dispensing passage and/or into the at least one dispensing passage to carry away any volume of fluid remaining along the central dispensing passage and along at least a portion of the fluid dispensing passage.

11. The system of claim 8 wherein at least some of the plurality of air passages are configured and disposed within the interior of the fluid block in relation to at least some of the fluid dispensing passages such that at least one air passage delivers purge air into some of the non-dispensing fluid dispensing passages to prevent flow of unselected fluids into the fluid block.

12. The system of claim 1 wherein the volume of fluid includes liquid, liquid-based, or liquid-dispersed food flavorings, food ingredients, or food, nutritional or energy supplements, and combinations thereof.

13. The system of claim 1 wherein at least a portion of an interior of the at least one air passage and of an interior of the at least one dispensing passage include non-stick surfaces.

14. The system of claim 1 wherein at least a portion of an interior of the at least one air passage and of an interior of the at least one dispensing passage are constructed with one or more materials suitable for use in food production selected from the group consisting of plastic, stainless steel, ceramic, and combinations thereof.

15. The system of claim 1 wherein the valve-less fluid block is constructed and arranged to receive pressurized air into the at least one air passage to pressurize the interior of the fluid block.

16. The system of claim 1 wherein the at least one air passage includes two or more air passages in fluid communication with the central dispensing passage, and wherein the at least one fluid dispensing passage includes two or more dispensing passages in fluid communication with the central dispensing passage, each fluid dispensing passage being connected to a flow channel disposed external to the fluid block and coupled operatively to a fluid container, and each fluid container being coupled operatively to a pump.

* * * * *